US009793687B2

(12) United States Patent
Deguchi et al.

(10) Patent No.: US 9,793,687 B2
(45) Date of Patent: Oct. 17, 2017

(54) SPARK PLUG FOR INTERNAL COMBUSTION ENGINE, HAVING AN ANNULAR GROUND ELECTRODE FACING AN OUTER CIRCUMFERENCE OF A CENTER ELECTRODE

(71) Applicant: DENSO CORPORATION, Kariya, Aichi-pref. (JP)

(72) Inventors: Masataka Deguchi, Kariya (JP); Masamichi Shibata, Kariya (JP); Kanechiyo Terada, Kariya (JP); Tetsuya Miwa, Kariya (JP); Hironori Osamura, Kariya (JP); Yuuki Tsukamoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/266,072

(22) Filed: Sep. 15, 2016

(65) Prior Publication Data

US 2017/0077679 A1 Mar. 16, 2017

(30) Foreign Application Priority Data

Sep. 15, 2015 (JP) ..... 2015-182148

(51) Int. Cl.

| | |
|---|---|
| ***H01T 13/16*** | (2006.01) |
| ***F02P 15/00*** | (2006.01) |
| ***H01T 13/32*** | (2006.01) |
| *H01T 13/14* | (2006.01) |
| *H01T 13/00* | (2006.01) |

(52) U.S. Cl.

CPC ..... *H01T 13/16* (2013.01); *F02P 15/00* (2013.01); *H01T 13/32* (2013.01); *H01T 13/00* (2013.01); *H01T 13/14* (2013.01)

(58) Field of Classification Search

CPC ..... H01T 13/16; H01T 13/38; F02P 15/00

See application file for complete search history.

(56) References Cited

U.S. PATENT DOCUMENTS

| | | | |
|---|---|---|---|
| 2,586,864 | A | 2/1952 | Rose |
| 2007/0069618 | A1 | 3/2007 | Havard et al. |
| 2013/0206101 | A1 | 8/2013 | Douglas et al. |
| 2016/0064903 | A1 | 3/2016 | Deguchi et al. |
| 2017/0077682 | A1 | 3/2017 | Deguchi |

*Primary Examiner* — Joseph L Williams

(74) *Attorney, Agent, or Firm* — Nixon & Vanderhye P.C.

(57) ABSTRACT

A spark plug for an internal combustion engine is provided which includes a housing, a porcelain insulator, a center electrode, and an annular ground electrode. The housing has a small-diameter portion which has a smaller inner diameter and defines a front end thereof. The ground electrode is secured to a front end surface of the small-diameter portion and forms a spark gap between itself and an outer periphery of the center electrode. A pocket is formed between the inner periphery of the housing and a portion of the porcelain insulator which is located closer to a front end of the porcelain insulator than the mounting shoulder is. An air vent extends from outside the ground electrode in a radial direction of the spark plug to the pocket to establish communication between the pocket and the combustion chamber of the internal combustion engine.

7 Claims, 18 Drawing Sheets

SPARK PLUG FOR INTERNAL COMBUSTION ENGINE, HAVING AN ANNULAR GROUND ELECTRODE FACING AN OUTER CIRCUMFERENCE OF A CENTER ELECTRODE

CROSS REFERENCE TO RELATED DOCUMENT

The present application claims the benefit of priority of Japanese Patent Application No. 2015-182148 filed on Sep. 15, 2015, the disclosure of which is incorporated herein by reference.

BACKGROUND

1 Technical Field

This disclosure relates generally to a spark plug for internal combustion engines which has an annular ground electrode disposed to face an outer circumference of a center electrode, and a production method thereof.

2 Background Art

For instance, Japanese Patent No. 5075127 discloses a spark plug for use in internal combustion engines mounted in automotive vehicles or cogeneration systems. The spark plug has an annular ground electrode which faces an outer periphery of a center electrode. The joint of the ground electrode to a housing of the spark plug is achieved by crimping a front end of the housing inwardly to define a spark gap between the outer circumference of the center electrode and the inner circumference of the annular ground electrode.

The above spark plug, as described above, has the structure in which the ground electrode is tightly held inside the crimped front end of the housing to make a mechanical contact of the outer periphery of the ground electrode with the housing, thus resulting in an increased length of a heat dissipating path between the inner peripheral surface of the ground electrode which faces the spark gap and the housing. This increases the risk of higher temperatures occurring in the ground electrode, which usually leads to an increase in mechanical wear of portions of the electrodes around the spark gap, thereby accelerating the rate at which the size of the spark gap increases, thereby shortening the time taken to reach an upper limit of a size of the spark gap. It is, thus, difficult to produce spark plugs which have an increased service life.

The ground electrode is disposed inside the housing. The spark gap has an end located inside the front end of the housing in the lengthwise direction of the spark plug, thus encountering a probability that it is difficult for flame, as created by a spark generated in the spark gap, to grow, that is, a cooling loss increases in the spark plug, which will result in a reduced ability to ignite fuel in the engine.

The above spark plug, as described above, has the ground electrode tightly pressed inside the housing. It is, thus, difficulty to adjust the position of the ground electrode, that is, the size of the spark gap. Specifically, the accurate creation of the spark gap between the outer periphery of the center electrode and the inner periphery of the ground electrode requires increased accuracy in positioning the ground electrode relative to the center electrode. A variation in dimension or an assembling error of parts such as the housing etc. results in a failure in forming a desired spark gap even if the ground electrode is accurately positioned relative to the housing, thus requiring the need to position the ground electrode relative to the center electrode. However, in the structure in which the ground electrode is disposed radially inside the crimped front end of the housing, a great variation in dimension or a great assembling error of parts of the spark plug will restrict movement of the ground electrode in a radial direction of the spark plug. It is, thus, difficult to accurately adjust the size of the spark gap.

SUMMARY

It is therefore an object to provide a spark plug for an internal combustion engine which is designed to have an increased service life, an enhanced ability to ignite fuel, and a spark gap which is easy to adjust.

According to one aspect of the invention, there is provided a spark plug for an internal combustion engine which comprises: (a) a cylindrical housing which is designed to be mounted in an internal combustion engine so as to be exposed to a combustion chamber of the internal combustion engine; (b) a cylindrical porcelain insulator which is retained inside the housing; (c) a center electrode which is retained inside the porcelain insulator and has a head extending outside a front end of the porcelain insulator; and (d) an annular ground electrode which is secured to a front end of the housing.

The housing has a small-diameter portion formed on the front end thereof. The small-diameter portion has an inner diameter which is smaller than that of a rest of the housing.

The ground electrode protrudes from a front end surface of the small-diameter portion and has an inner peripheral surface facing an outer peripheral surface of the center electrode The ground electrode has an outer diameter which is smaller than an outer diameter of the front end surface of the small-diameter portion.

The porcelain insulator has a mounting shoulder formed on an outer periphery thereof, and the housing has a seat shoulder formed on an inner periphery thereof. The mounting shoulder rides on the seat shoulder from a base side of the spark plug in an axial direction of the spark plug to retain the porcelain insulator in the housing.

A pocket is formed between the inner periphery of the housing and a portion of the porcelain insulator which is located closer to a front end of the porcelain insulator than the mounting shoulder is.

The housing has formed therein an air vent which extends from outside the ground electrode in a radial direction of the spark plug to the pocket to establish communication between the pocket and the combustion chamber of the internal combustion engine.

In the spark plug as described above, the outer diameter of the ground electrode is smaller than that of the front end surface of the small-diameter portion of the housing. The ground electrode is welded to the front end surface of the small-diameter portion of the housing. The ground electrode and the housing, therefore, face each other in contact with each other in an axial direction of the spark plug. Specifically, the ground electrode and the housing continuously and fully contact each other in the circumferential direction of the spark plug, thereby ensuring a large area of the contact and shortening a heat dissipating path between the inner peripheral surface of the ground electrode facing the spark gap and the housing. This enhances the release of heat from the ground electrode which is exposed to combustion of fuel in the engine and heated to high temperature to the housing mounted in an engine head, thus minimizing a rise in temperature of the ground electrode, thereby reducing mechanical wear of the inner peripheral surface of the ground electrode, which retards an increase in size of the spark gap to obtain a desired service life of the spark plug.

The ground electrode projects from the front end surface of the housing, so that the spark gap is located outside the front end of the housing in the axial direction of the spark plug, thereby avoiding contact of the flame, as created by a spark generated in the spark gap, with the housing, which usually causes the heat of the flame to be drawn into the housing, thus resulting in a failure in growing the flame. In other words, the cooling loss of thermal energy required to grow the flame is minimized to improve the ability of the spark plug to ignite the fuel.

The spark plug is designed to have the ground electrode which faces the outer peripheral surface of the center electrode and is welded to the front end surface of the small-diameter portion of the housing, thus facilitating the ease with which the ground electrode is positioned to the center electrode when they are welded together. Specifically, when the ground electrode is welded to the housing, it is possible to move the ground electrode along the front end surface of the small-diameter portion of the housing to fix a desired location of the ground electrode relative to the center electrode regardless of a variation in dimension of the parts of the spark plug, which facilitates the ease of adjustment of the spark gap between the center electrode and the ground electrode.

The housing has the vent holes formed therein, thus enhancing scavenging of the pocket that is, reducing the amount of residual gas accumulated in the pocket. This enhances the efficiency in scavenging the pocket during an exhaust stroke in the internal combustion engine and also facilitates suction of fresh air into the pocket, thereby enhancing the ability of the spark plug to ignite the fuel.

This disclosure, therefore, provides the spark plug and the production method of the spark plug which has an increased service life, an enhanced ability to ignite fuel, and a spark gap easy to adjust.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENT

First Embodiment

Figure 1:
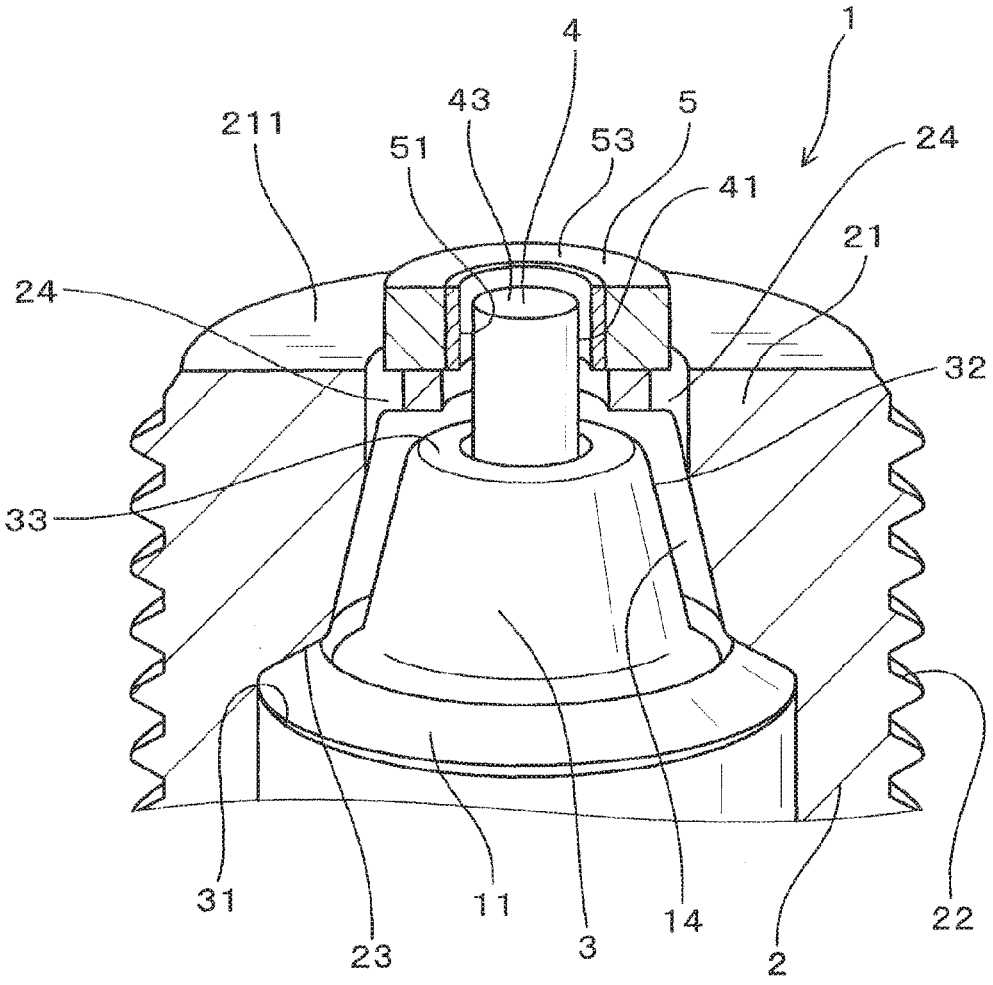
FIG. 1 is a partial perspective sectional view which illustrates a region around a front end portion of a spark plug according to the first embodiment.

The spark plug 1 for use with an internal combustion engine and a production method thereof will be described below with reference to FIGS. 1 to 7.

The spark plug 1 of the first embodiment, as illustrated in FIGS. 1 to 4, includes a hollow cylindrical housing 2 (also called a shell), a cylindrical porcelain insulator 3, a center electrode 4, and an annular ground electrode 5.

The housing 4 is installed in the internal combustion engine 100 with a front end (i.e., a head) thereof exposed to a combustion chamber 61 of the internal combustion engine 100. The porcelain insulator 3 is retained inside the housing 2. The center electrode 4 is retained inside the porcelain insulator 3 and partially projects from a front end of the porcelain insulator 3. The annular ground electrode 5 is secured to the front end of the housing 2.

The housing 2 has a small-diameter portion 21 formed on the front end of the housing 2. The small-diameter portion 21 has an inner diameter D4 which is smaller than that of the rest of the housing 2.

The ground electrode 5 is placed on a front end surface 211 of the small-diameter portion 21. In other words, the ground electrode 5 projects from the front end surface 211 in an axial direction of the spark plug 1. The ground electrode 5 has an inner peripheral surface 51 facing an outer peripheral surface 41 of the center electrode 4. The ground electrode 5 preferably has a front end surface 53 located outside a front end surface 43 of the center electrode 4 in the axial direction of the spark plug 1. The ground electrode 5 has an outer diameter D1 which is smaller than an outer diameter D0 of a front end surface 211 of the small-diameter portion 21.

The porcelain insulator 3 has a mounting shoulder 31 formed on an outer periphery thereof. The housing 2 has a seat shoulder 23 formed in an inner peripheral surface thereof. The porcelain insulator 3 is retained inside the housing 2 in alignment therewith in the axial direction of the spark plug 1 with the mounting shoulder 21 riding on the seat shoulder 23 of the housing 2. The porcelain insulator 3 also has an insulator nose 32 located closer to the tip thereof than the mounting shoulder 31 is. A pocket 14 is formed between the insulator nose 32 and the inner peripheral wall of the housing 2.

The housing 2 has formed therein vent holes 24 which communicate between the pocket 14 and the combustion chamber 61 of the engine 100 through an outer circumferential surface of the ground electrode 5. The pocket 14 also communicates with the combustion chamber 61 through the spark gap, in other words, inside the ground electrode 5. Since the spark gap is very narrow, the vent holes 24 are provided outside the ground electrode 5 for compensating for a lack in volume of an air passage defined by the spark gap.

The spark plug 1 is used as an igniter in internal combustion engines mounted in, for example, automotive vehicles or cogeneration systems. In the following discussion, when the spark plug 1 is installed in the internal combustion engine 100, a portion of the spark plug 1 exposed to the combustion chamber 61 of the internal combustion engine 100 will also be referred to as a front end or a front end side, while a portion of the spark plug 1 furthest away from the front end will also be referred to as a base end or a base end side. A plug axial direction, a plug radial direction, and a plug circumferential direction, as referred to herein, are a lengthwise direction, a radial direction, and a circumferential direction of the spark plug 1, respectively.

Figure 3:
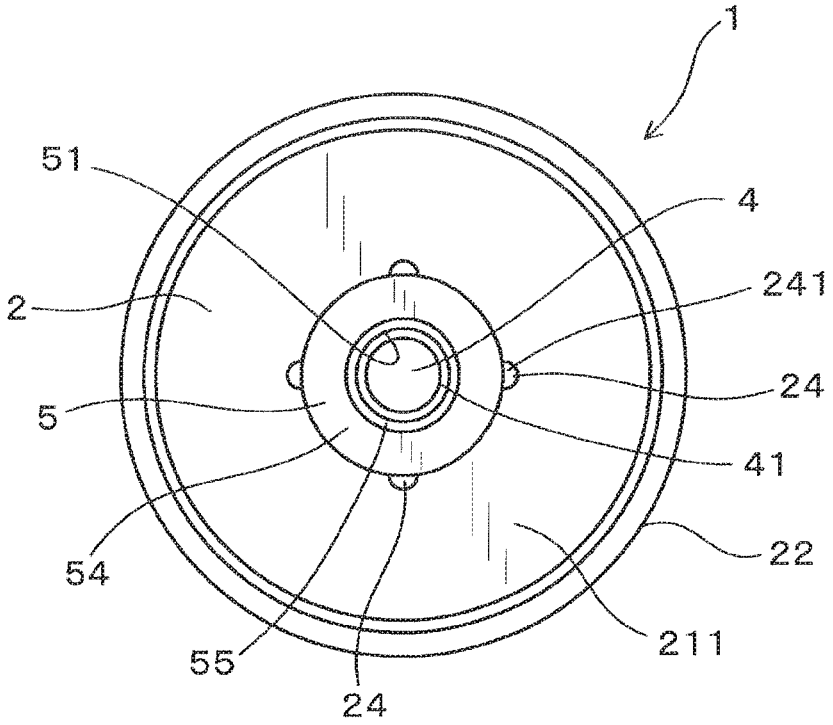
FIG. 3 is a plane view which illustrates a spark plug, as viewed from a top end thereof.

The center electrode 4 of this embodiment is, as can be seen in FIGS. 1 and 3, of substantially a cylindrical shape and arranged coaxially with the cylindrical housing 2, the cylindrical porcelain insulator 3, and the cylindrical ground electrode 5.

Figure 4:
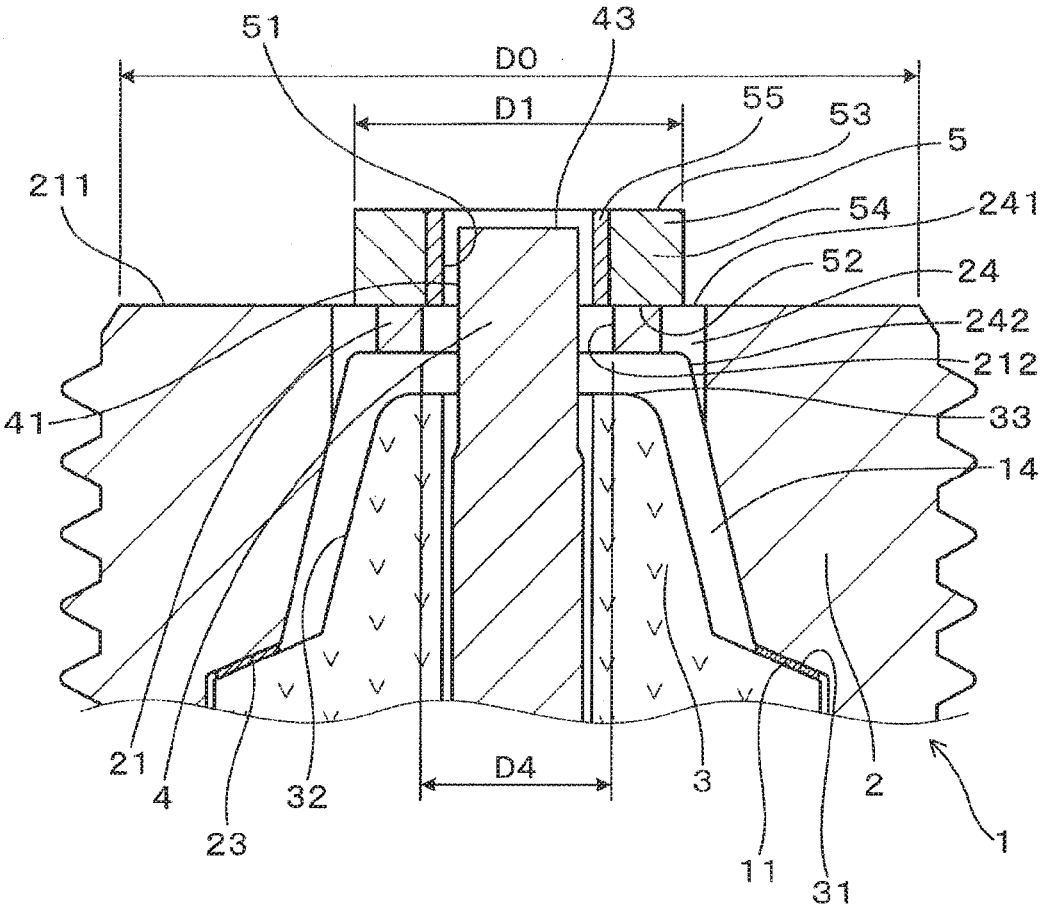
FIG. 4 is a partial section view which illustrates a region around a top end portion of a spark plug of the first embodiment.

The porcelain insulator 3, as illustrated in FIGS. 1 and 4, has the mounting shoulder 31 which tapers toward the based end of the insulator nose 32. The housing 2 has formed on the inner peripheral wall thereof the tapered seat shoulder 23 which faces the mounting shoulder 31 of the porcelain insulator 3. The seat shoulder 23 and the mounting shoulder 31 are placed in contact with each other through an annular packing (also called a gasket) 11, thereby aligning the porcelain insulator 3 with the housing 2 in the plug axial direction. The insulator nose 32 which is located closer to the tip of the spark plug 1 than the packing 11 is defines the pocket 14 between itself and the inner periphery of the housing 2.

Each of the vent holes 24 formed in the housing 2 has an end opening to the pocket 14, so that the pocket 14 communicates with the combustion chamber 61 through the vent holes 24 when the spark plug 1 is installed in the internal combustion engine 100. The vent holes 24 also open at the front end surface 211 of the small-diameter portion 21. The vent holes 24 extend parallel in the plug axial direction.

Figure 5:
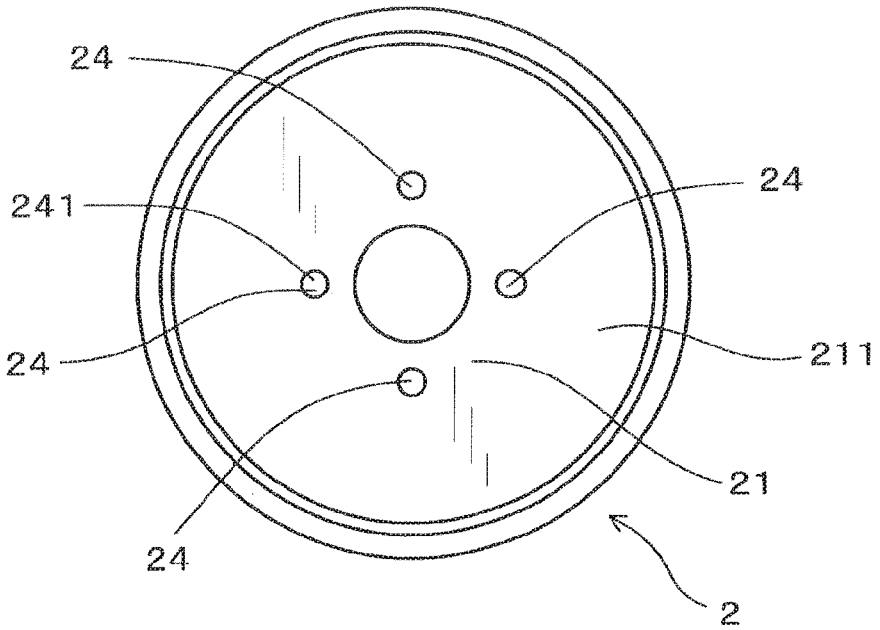
FIG. 5 is a plane view which illustrates a front end of a housing of a spark plug before a ground electrode is joined to the housing in the first embodiment.

The vent hole 24 are, as clearly illustrated in FIGS. 3 and 5, arranged at equal angular intervals away from each other in the plug circumferential direction. In this embodiment, the four vent holes 24 are arrayed at equal angular intervals away from each other. Each of the vent holes 24 has a circular transverse section, as viewed from the plug axial direction. This geometry facilitates the formation of the vent holes 24, but however, the vent holes 24 may be designed to have another shape. An approximately half of the front end of each of the vent holes 24 is closed by the ground electrode 5, thereby reducing a shock wave pressure, as created by combustion of fuel in the engine 100, exerted on the front end surface 33 of the porcelain insulator 3 to alleviate possible adverse effects on the porcelain insulator 3.

Each of the vent holes 24 is, as shown in FIGS. 3 and 4, located to partially overlap with the ground electrode 5, as viewed from the plug axial direction. In other words, each of the vent holes 24 has a front opening 241 which is partly blocked by the ground electrode 5. The opening 241 of each of the vent holes 24 has an outer portion which is located outward in the plug radial direction and not closed by the ground electrode 5. In other words, the opening 241 of each of the vent holes 24 is partially located outside the outer periphery of the ground electrode 5, so that a circumscribed circle which passes through outermost points of all the openings 241 is positioned outside the profile of the ground electrode 5, as viewed in the plug axial direction.

Each of the vent holes 24 also has an opening 242 which is formed in an opposite end thereof, in other words, located closer to the base end of the spark plug 1 (i.e., the housing 2) than the opening 241 is. The opening 241 will also be referred to below as a front side opening. The opening 242 will also be referred to below as a base side opening. Each of the openings 242 is exposed to the pocket 14 and located inside the pocket 11 in the plug radial direction. The vent holes 24 extend parallel to each other in the plug axial direction. Each of the vent holes 24 has an outermost portion in the plug radial direction which is located closer to the center of the spark plug 1 than the packing 11 is and closer to the outer periphery of the spark plug 1 than the ground electrode 5 is. In other words, the outermost portion of each of the vent holes 24 lies between the ground electrode 5 and the packing 11 in the plug radial direction.

Figure 2:
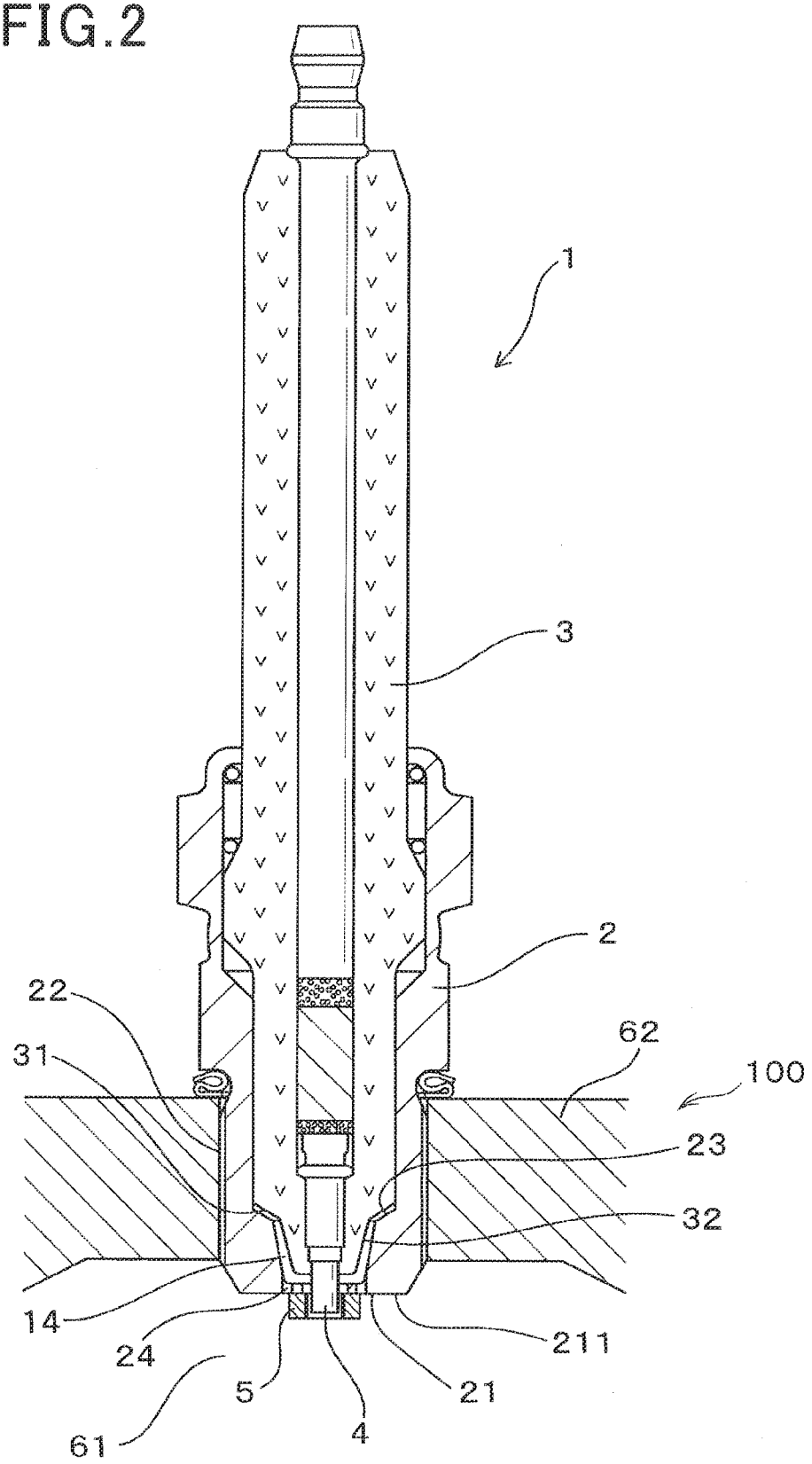
FIG. 2 is a longitudinal sectional view which illustrates a spark plug mounted in an internal combustion engine according to the first embodiment.

The housing 2, as illustrated in FIGS. 1 and 2, has an attachment screw 22 for mounting the spark plug 1 in the engine head 62 of the internal combustion engine 100 and is made of, for example, Fe-based alloy.

Figure 7A:
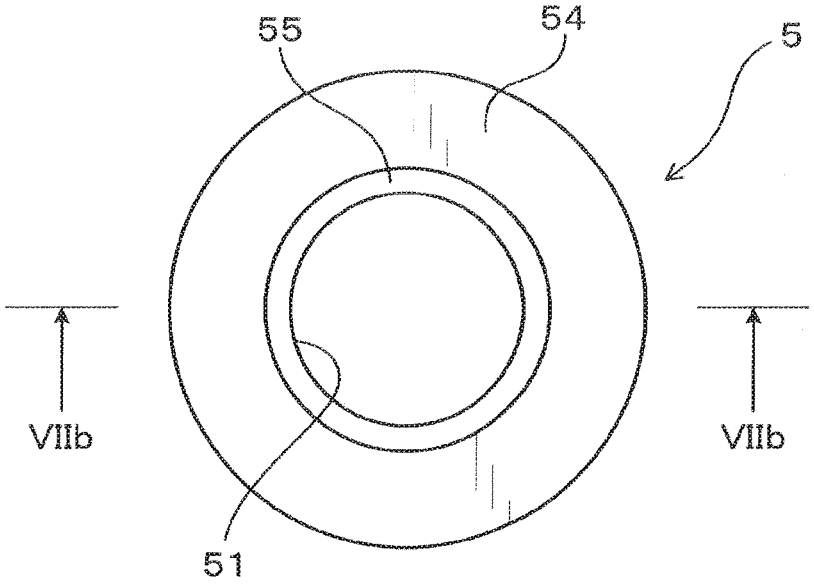
FIG. 7(A) is a plane view of a ground electrode of a spark plug in the first embodiment.
Figure 7B:
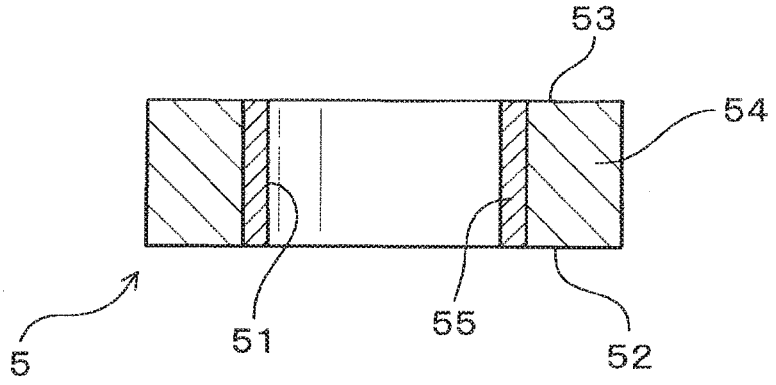
FIG. 7(B) is a sectional view, as taken along the line VIIb-VIIb of FIG. 7(A)

The ground electrode 5, as illustrated in FIGS. 7(A) and 7(B), includes an annular main electrode body 54 and a noble metal layer 55 formed on an inner peripheral surface of the main electrode body 54. The main electrode body 54 is made of, for example, Ni-based alloy. The noble metal layer 55 is made of, for example, platinum (Pt) or Iridium (Ir) or an alloy thereof. The noble metal layer 55 is diffusion-bonded to the main electrode body 54. The noble metal layer 55 has a thickness of, for example, 0.1 mm to 0.5 mm. The ground electrode 5 is, as described above, made up of two parts: the main electrode body 54 and the noble metal layer 55 in order to enhance the wear-resistance of the ground electrode 5 to increase the service life of the spark plug 1.

A production method of the spark plug 1 will be described below. The spark plug 1 is produced in a sequence of assembling steps and a joining step.

Figure 6:
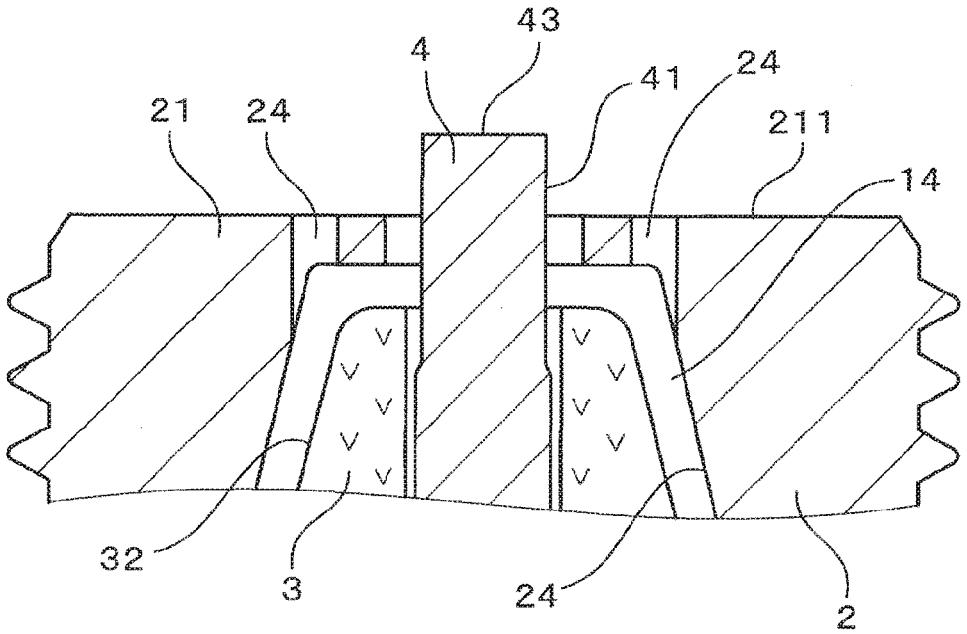
FIG. 6 is a partial section view which illustrates a region around a top end portion of a spark plug before a ground electrode is joined to a housing in the first embodiment.

The assembling steps are, as illustrated in FIG. 6, steps to prepare an assembly of the porcelain insulator 3 and the center electrode 4 and then install the assembly inside the housing 2 so as to have the center electrode 4 inserted into the inner periphery of the small-diameter portion 21.

The joining step is made following the assembling steps, as illustrated in FIG. 4, to connect the ground electrode 5 to the small-diameter portion 21 of the housing 2. In the joining step, the size of the spark gap between the ground electrode 4 and the center electrode 4 is adjusted.

The vent holes 24 are made by drilling the housing 2 prior to the assembling steps.

Specifically, in the joining step, the ground electrode 5 which is, as can be seen in FIGS. 7(A) and 7(B), of an annular shape is put on the front end surface 211 of the small-diameter portion 21 of the housing 2 so as to have the center electrode 4 placed inside the ground electrode 5. The ground electrode 5 is slid on the front end surface 211 of the housing 2 in the radial direction thereof to regulate the position thereof relative to the center electrode 4 and located in place. Specifically, the spark gap between the outer peripheral surface 41 of the center electrode 4 and the inner peripheral surface 51 of the ground electrode 5 is set to a desired distance. In other words, the ground electrode 5 is moved and located so as to equalize the spark gap between entire circumferences of the outer peripheral surface 41 of the center electrode 4 and the inner peripheral surface 51 of the ground electrode 5. When the top end surface 211 of the housing 2 is flat extending perpendicular to the plug axial direction, it facilitates the positioning of the ground electrode 5 on the housing 2. The ground electrode 5 is positioned in place on the housing 2 and joined to the housing 2 by, for example, resistance-welding or laser-welding.

In the above way, the spark plug 1 shown in FIGS. 1 to 4 is produced in which the spark gap having a required size is formed between the outer peripheral surface 41 of the center electrode 4 and the inner peripheral surface 51 of the ground electrode 5.

The spark plug 1, as described already, has the ground electrode 5 welded to the front end surface 211 of the small-diameter portion 21 of the housing 2, so that the ground electrode 5 is placed in face-to-face contact with the housing 2 in the plug axial direction. The ground electrode 5 and the housing 2 are, thus, continuously and fully placed in contact with each other in the plug circumferential direction, thereby ensuring in a large area of contact therebetween and a shortening a distance of a heat dissipating path between the inner peripheral surface 51 of the ground electrode 5 facing the spark gap and the housing 2. This decreases a rise in temperature of the ground electrode 5, thereby reducing mechanical wear of the inner peripheral surface 51 of the ground electrode 5, which ensures an increased service life of the spark plug 1.

The ground electrode 5 projects from the front end surface 211 of the housing 2, so that the spark gap is located outside the front end of the housing 2 in the axial direction of the spark plug 1, thereby avoiding contact of the flame, as created by a spark generated in the spark gap, with the housing 2, which usually causes the heat of the flame to be drawn into the housing 2, thus resulting in a failure in growing the flame. In other words, the cooling loss of thermal energy required to grow the flame is minimized to improve the ability of the spark plug 1 to ignite the fuel.

The spark plug 1 is designed to have the ground electrode 5 which faces the outer peripheral surface of the center electrode 4 and is welded to the front end surface 211 of the small-diameter portion 21 of the housing 2, thus facilitating the ease with which the ground electrode 5 is positioned to the center electrode 4 when they are welded together. Specifically, when the ground electrode 5 is welded to the housing 2, it is possible to move the ground electrode 5 along the front end surface 211 of the small-diameter portion 21 of the housing 2 to fix a desired location of the ground electrode 5 relative to the center electrode 4 regardless of a variation in dimension of the parts of the spark plug 1, which facilitates the ease of adjustment of the spark gap between the center electrode 4 and the ground electrode 5.

The housing 2 has the vent holes 24 formed therein, thus enhancing scavenging of the pocket 14, that is, reducing the amount of residual gas accumulated in the pocket 14. This enhances the efficiency in scavenging the pocket 14 during an exhaust stroke in the internal combustion engine 100 and also facilitates suction of fresh air into the pocket 14, thereby enhancing the ability of the spark plug 1 to ignite the fuel.

The vent holes 24 open at the front end surface 211 of the small-diameter portion 21, so that it is directly subjected to a change in pressure in the combustion chamber 61 of the internal combustion engine 100 arising from the combustion of fuel or motion of the piston, thereby enhancing the efficiency in scavenging residual gas from the pocket 14 into the combustion chamber 61. The vent holes 24 extend parallel to each other in the plug axial direction, thereby quickly draining the residual gas from the pocket 14 during the exhaust stroke of the internal combustion engine 100. The vent holes 24 are arranged at equal intervals away from each other in the plug circumferential direction, thereby causing the residual gas to be uniformly drawn from the pocket 14 over the circumference of the spark plug 1. Each of the vent holes 24 has the opening 241 which is partially closed, so that an area of the opening 241 directly exposed outside the vent hole 24 is decreased, thereby reducing a shock wave pressure, as created by combustion of fuel in the internal combustion engine 100, exerted on the front end surface 33 of the porcelain insulator 3.

This embodiment, as apparent from the above discussion, provides the spark plug 1 for internal combustion engines which has an increased service life, enhanced ability to ignite fuel, and the spark gap easy to adjust.

Second Embodiment

Figure 8:
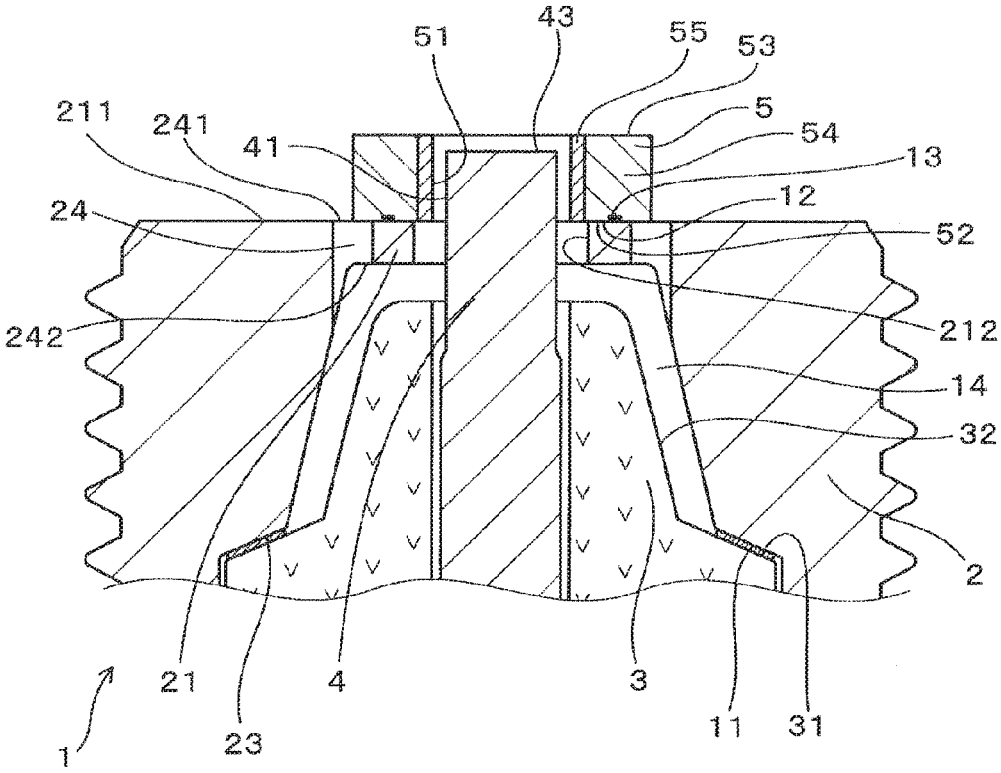
FIG. 8 is a partial perspective sectional view which illustrates a region around a front end portion of a spark plug according to the second embodiment.
Figure 9:
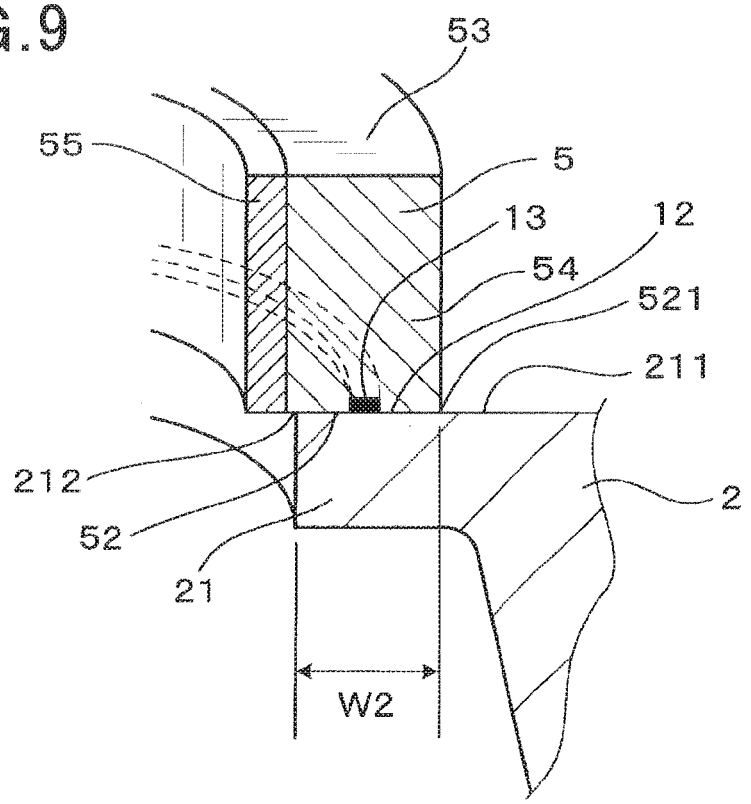
FIG. 9 is a partial perspective sectional view which illustrates a region around a ground electrode welded to a housing of a spark plug of the second embodiment.
Figure 10:
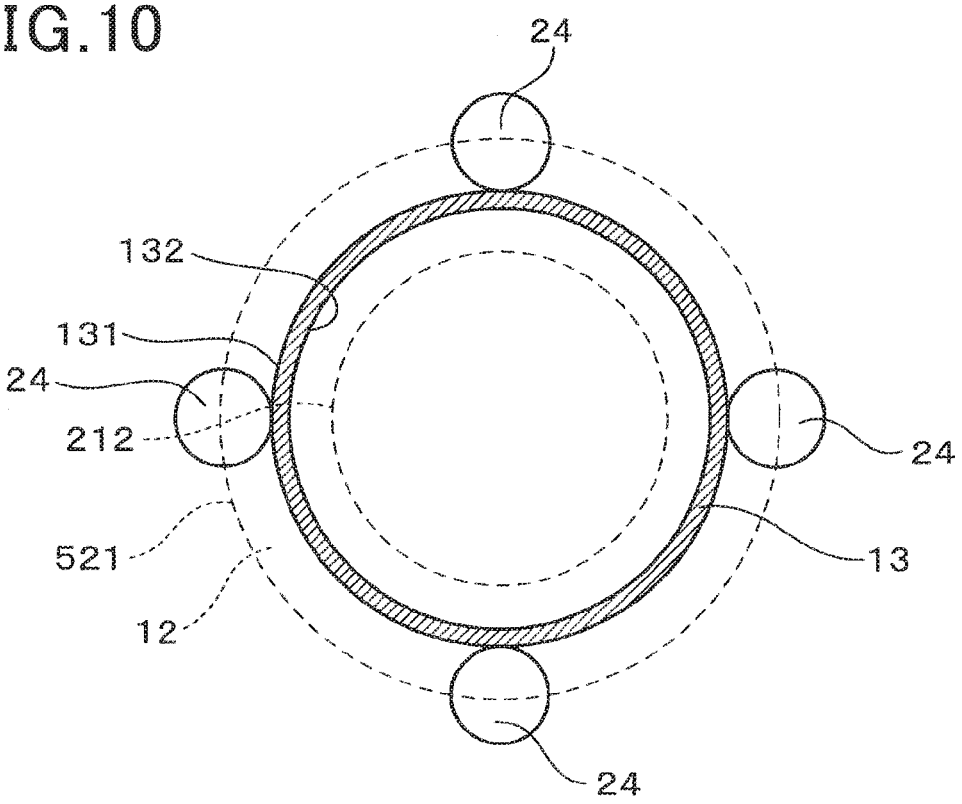
FIG. 10 is an explanatory view which represents a positional relation between an annular boundary and an annular weld of a spark plug of the second embodiment.

The spark plug 1 of this embodiment, as illustrated in FIGS. 8 to 10, has an annular weld 13 which welds the housing 2 and the ground electrode 5 together. The annular weld 13 is shaped to occupy a portion of a width of the ground electrode 5 which extends in the plug circumferential direction.

Figure 11:
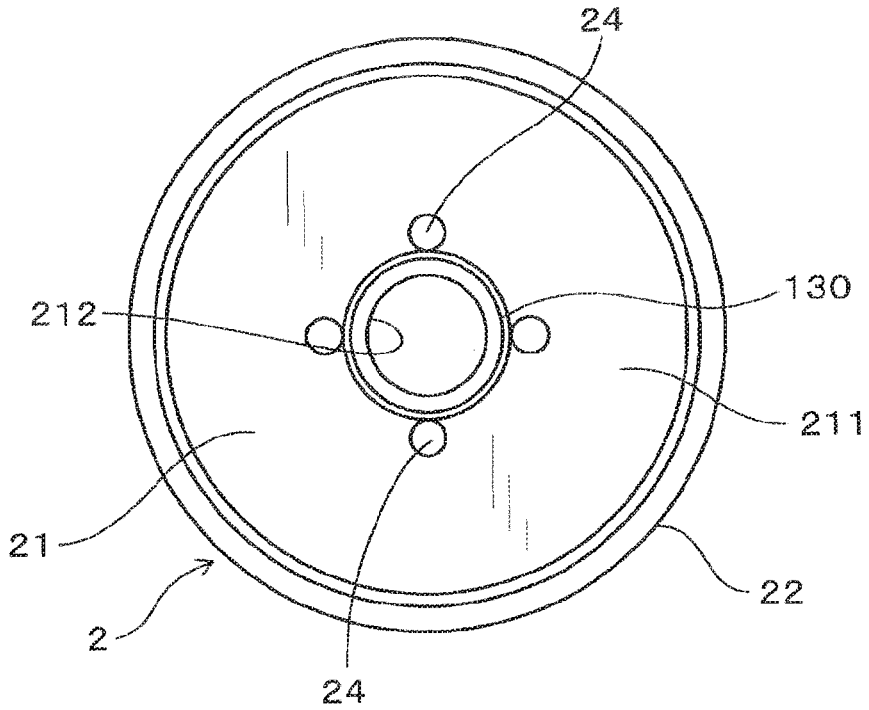
FIG. 11 is a plane view which illustrates a front end of a housing of a spark plug before a ground electrode is joined to the housing in the second embodiment.
Figure 12:
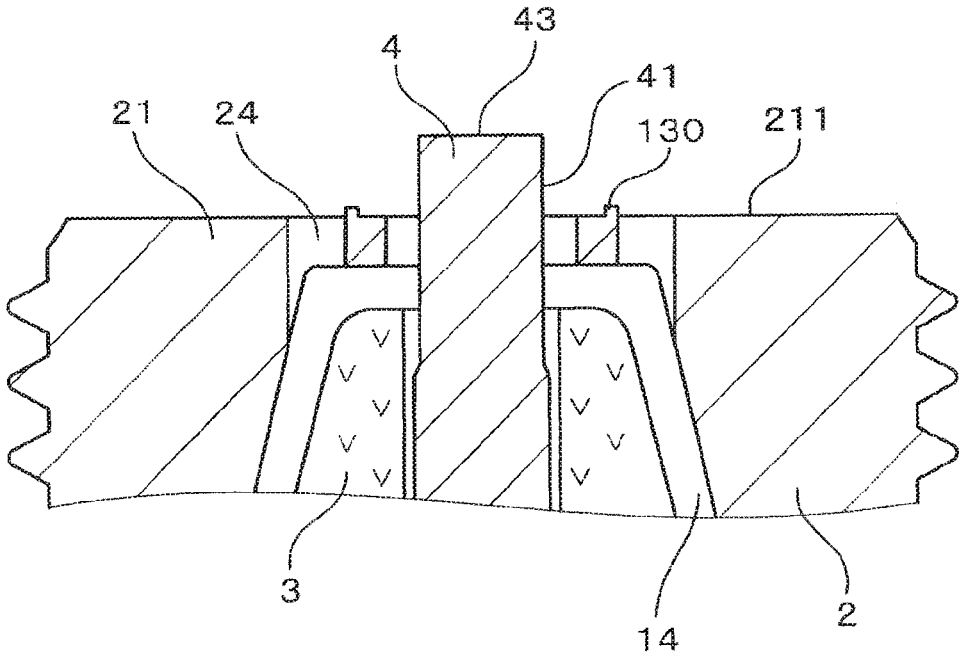
FIG. 12 is a partial section view which illustrates a region around a top end portion of a spark plug before a ground electrode is joined to a housing in the second embodiment.

Specifically, the front end surface 211 of the small-diameter portion 21 faces a base end surface 52 of the ground electrode 5 through an annular boundary 12. The annular boundary 12 has an annular region which occupies a portion of a width thereof and fully extends in a circumferential direction thereof and in which the annular weld 13 is formed. The annular weld 13, as illustrated in FIG. 10, continuously extends in the circumferential direction of the annular boundary 12. The air vents 24 are, as can be seen in FIGS. 10 to 12, located outside the annular weld 13 in the plug radial direction.

The annular weld 13 has an inner circumferential edge 132 located outside the inner circumferential edge 212 of the front end surface 211 of the small-diameter portion 21. The annular weld 13 has an outer circumferential edge 131 located inside the outer circumferential edge 521 of the base end surface 52 of the ground electrode 5.

The annular weld 13 is, as can be seen in FIG. 9, shaped to bite from the front end surface 211 of the small-diameter portion 21 into the ground electrode 5. Specifically, the annular weld 13 is embedded deeply from the base end surface 52 of the ground electrode 5.

The air vents 24 are partially located outside the outer circumference of the annular boundary 12, that is, the outer circumferential edge 521 of the base end surface 52 of the ground electrode 5.

The joining of the ground electrode 5 to the front end surface 211 of the small-diameter portion 21 is achieved by the resistance-welding.

Figure 13:
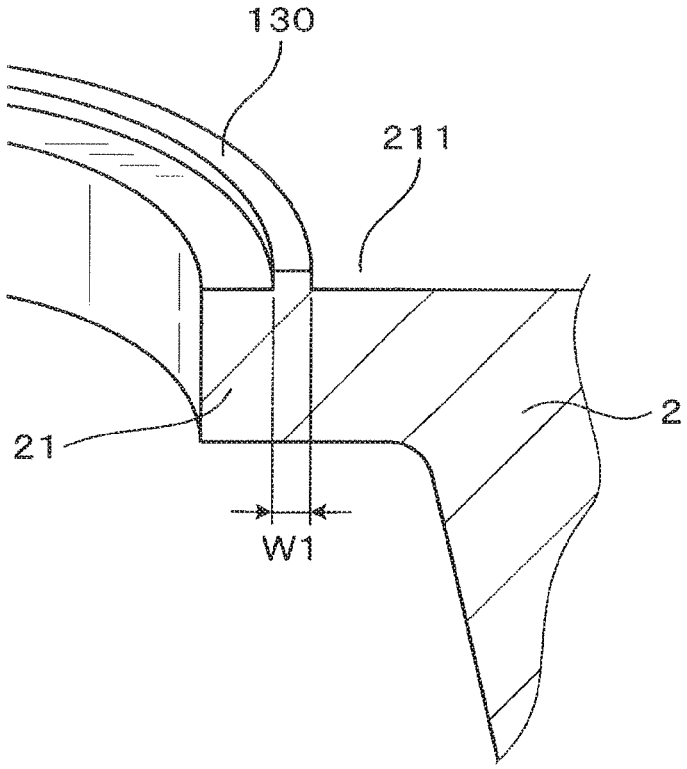
FIG. 13 is a partial perspective sectional view which illustrates a small-diameter portion of a housing before a ground electrode is welded to the housing in a spark plug of the second embodiment.

Before the ground electrode 5 is welded to the housing 2, the front end surface 211 of the housing 2, as illustrated in FIGS. 11 to 13, has an annular protrusion 130 formed thereon. The annular protrusion 130 continuously and fully extends in the circumferential direction of the small-diameter portion 21 of the housing 2.

The annular protrusion 130, as illustrated in FIG. 13, has a width W1 in the plug radial direction which is, as illustrated in FIG. 9, smaller than the width W2 of the annular boundary 12 in the plug radial direction. The air vents 24 are formed outside the annular protrusion 130 of the housing 2 in the plug radial direction.

Figure 14A:
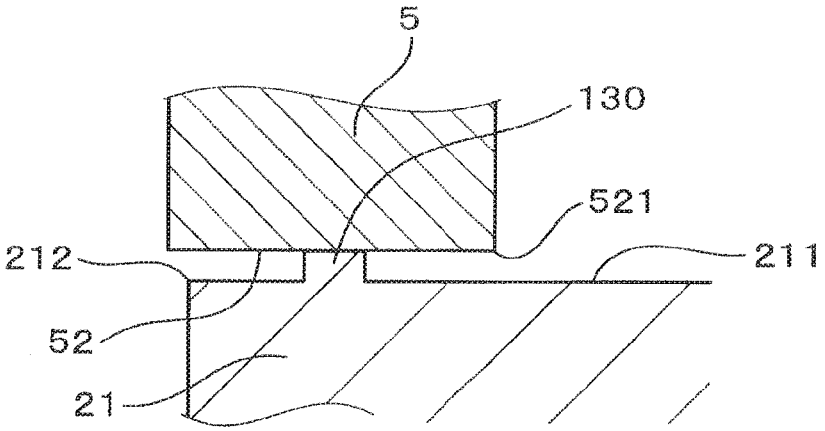
FIG. 14(A) is a plane view of a ground electrode placed in contact with an annular protrusion of a housing of a spark plug in the second embodiment.

In the joining step, the annular protrusion 130 is, as illustrated in FIG. 14(A), first placed in contact with the base end surface 52 of the ground electrode 5. The spark gap between the ground electrode 5 and the center electrode 4 is regulated. Specifically, after the assembling steps are performed, but before the ground electrode 5 is resistance-welded to the small-diameter portion 21, the position of the ground electrode 5 relative to the housing 2 is adjusted to set the spark gap between the ground electrode 5 and the center electrode 4. Subsequently, the ground electrode 5 is resistance-welded to the small-diameter portion 21.

The annular protrusion 130 of the housing 2 is, as described already, placed in contact with the ground electrode 5 to weld the ground electrode 5 to the housing 2. The welding is made between the base end surface 52 of the ground electrode 5 and the annular protrusion 130 on the front end surface 211 of the housing 2 over the entire circumference of the annular protrusion 130.

When the annular protrusion 130 is placed in contact with the base end surface 52 of the ground electrode 5, the inner circumferential edge of the annular protrusion 130 is, as can be seen in FIG. 14(A), located outside the inner circumferential edge 212 of the front end surface 211 of the small-diameter portion 21, while the outer circumferential edge of the annular protrusion 130 is located inside the outer circumferential edge 521 of the base end surface 52 of the ground electrode 5. The annular protrusion 130 is in contact with the base end surface 52 of the main electrode body 54 of the ground electrode 5.

The current is applied between the housing 2 and the ground electrode 5 with the annular protrusion 130 pressed in contact with the ground electrode 5. This produces heat between the annular protrusion 130 and the base end surface 52 of the ground electrode 5 to resistance-weld the housing 2 and the ground electrode 5 to each other. The mechanical contact between the housing 2 and the ground electrode 5 is achieved only between the annular protrusion 130 and the ground electrode 5. In other words, before welding, the housing 2 and the ground electrode 5 do not contact with each other on an area of the annular boundary 12 other than the annular protrusion 130. In the resistance-welding, the current, thus, flows only through a narrow annular area of contact between the annular protrusion 130 of the housing 2 and the ground electrode 5, thus resulting in a uniform increase in current density on the contact of the annular protrusion 130 and the ground electrode 5, which achieves uniform welding on the whole of the contact.

Figure 14B:
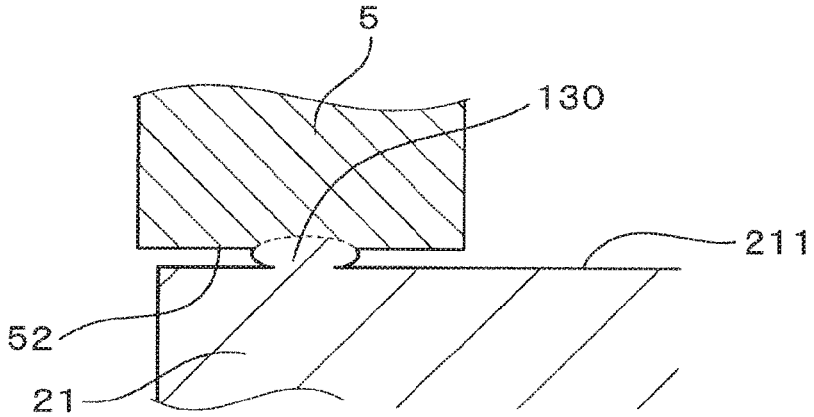
FIG. 14(B) is a partial sectional view which illustrates a ground electrode being welded to a housing during a joining step in the second embodiment.
Figure 14C:
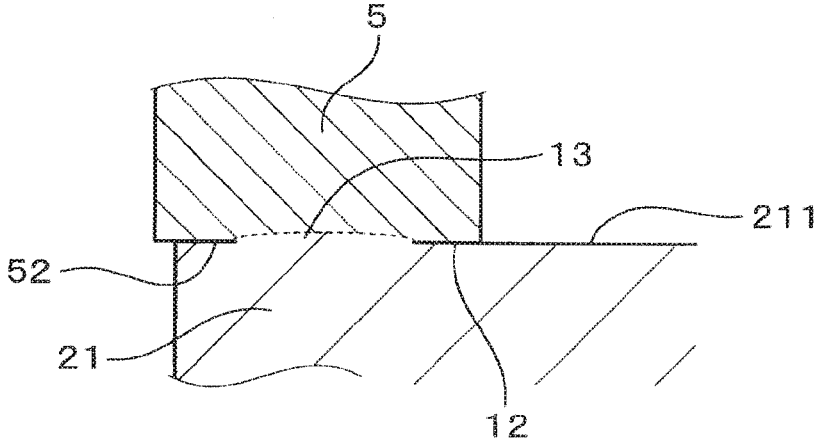
FIG. 14(C) is a partial sectional view which illustrates a ground electrode which has finished welded to a housing during a joining step in the second embodiment.

The annular protrusion 130 is, as demonstrated in FIGS. 14(A), 14(B), and 14(C), gradually melted and mixed with the base end surface 52 of the ground electrode 5 to complete the weld of the annular protrusion 130 and the ground electrode 5. In the case where the housing 2 is, as described above, made of Fe-based alloy, and the ground electrode 5 is made of Ni-based alloy, the ground electrode 5 mainly is melted by the resistance heat because the Ni-based alloy has a low melting point. This causes the annular protrusion 130 of the housing 2 to bite into and then be welded to the base end surface 52 of the ground electrode 5 to make the annular weld 13.

When the front end surface 211 of the small-diameter portion 21 of the housing 2 and the base end surface 52 of the ground electrode 5 fully contact each other, an area of the contact will be, as illustrated in FIG. 14(C), maximized, so that the current density will be small, thus completing the resistance welding.

The annular protrusion 130, as demonstrated in FIGS. 8 to 10, becomes the annular weld 13 which joints the housing 2 and the ground electrode 5 to each other and continuously and fully extends in a circumferential direction of the housing 2 (i.e., the ground electrode 5). Note that FIG. 9 emphasizes the configuration of the annular weld 13 embedded in the ground electrode 5 for the ease of visibility thereof.

The annular protrusion 130 has the width W1 in the plug radial direction which is selected to ensure the stability of the resistance welding and, for example, 0.1 mm to 1.0 mm. The height of the annular protrusion 130 in the plug axial direction is also selected to ensure the stability of the resistance welding and is, for example, 0.2 mm to 0.8 mm.

FIG. 14(A) demonstrates the annular protrusion 130 which has a rectangular section, as taken perpendicular to the plug circumferential direction, but however, it may be designed to have another shape.

Other arrangements are identical with those in the first embodiment. The structure of the spark plug 1 of this embodiment provides substantially the same beneficial advantages as in the first embodiment.

In the second and following embodiments, the same reference numbers as those in the first embodiment will refer to the same parts unless otherwise specified, and explanation thereof in detail is omitted.

The spark plug 1 of this embodiment is, as apparent from the above discussion, designed to have the annular weld 13 which occupies an annular portion of a width of the front end surface 211 of the small-diameter portion 21 of the housing 2 on the annular boundary 12 and fully and continuously extends in the circumferential direction of the front end surface 211. This ensures the stability in welding the ground electrode 5 to the small-diameter portion 21.

The air vents 24 are, as described above, located outside the annular weld 13, thus ensuring the stability in scavenging the pocket 14 without any undesirable interference with the annular weld 13.

The structure of the spark plug 1 of this embodiment provides substantially the same beneficial advantages as in the first embodiment.

Third Embodiment

Figure 15:
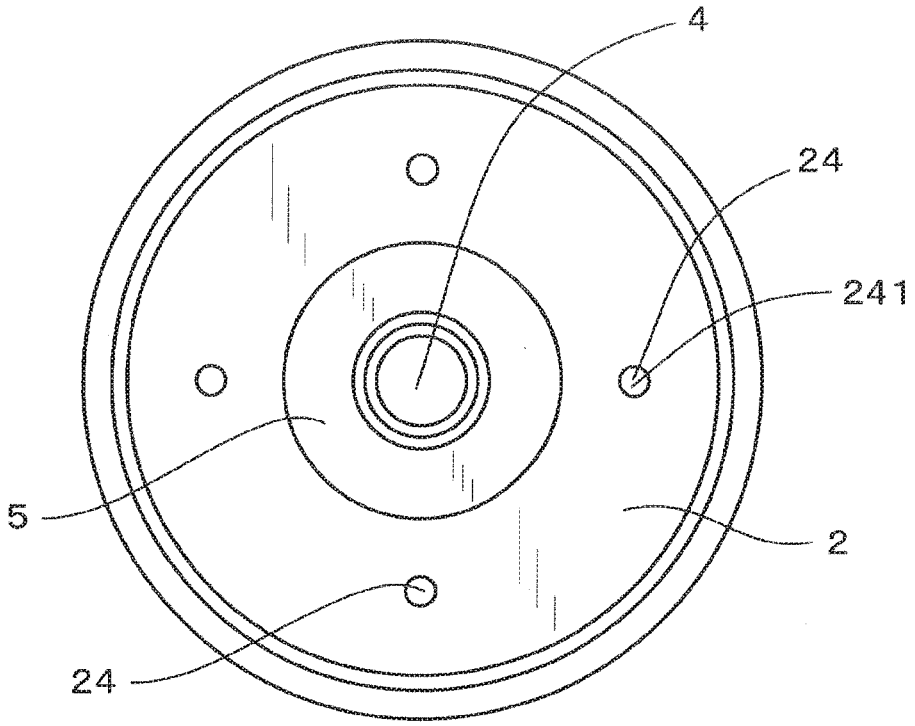
FIG. 15 is a plane view which illustrates a spark plug, as viewed from a top end thereof according to the third embodiment.
Figure 16:
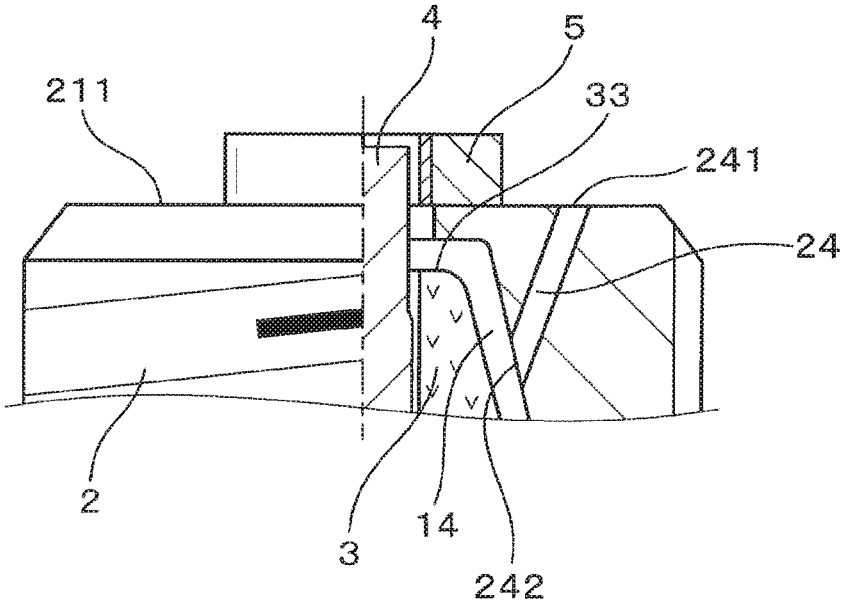
FIG. 16 is a partial longitudinal section view which illustrates a region around a top end portion of a spark plug of the third embodiment.

The spark plug 1 of this embodiment, as illustrated in FIGS. 15 and 16, have the vent holes 24 each of which is geometrically inclined at a given angle (except 0° and 90°) to the plug axial direction.

Specifically, each of the air vents 24, as can be seen in FIG. 16, extends upwardly and outwardly from the base end to the front end thereof. Each of the air vents 24, as clearly illustrated in FIG. 15, has the opening 241 which is fully located outside the outer circumference of the ground electrode 5. In other words, an inscribed circle which passes through outermost points of all the openings 241 is positioned outside the outer circumference of the ground electrode 5, as viewed in the plug axial direction.

Other arrangements are identical with those in the first embodiment.

The spark plug 1 of this embodiment is designed to have the air vents 24 with the openings 241 which are not closed by the ground electrode 5 at all, thus improving the ability of the spark plug 1 to scavenge the pocket 14. The inclination of the air vents 24 relative to the plug axial direction enables the front side openings 241 of the air vents 24 not to overlap with the ground electrode 5 and also the base side openings 242 of the air vents 24 not to overlap with the packing 11 in the plug axial direction. This also facilitates the ease with which the air vents 24 serve to scavenge the pocket 14. The base side openings 242 of the air vents 24 are located closer to the base end of the spark plug 1 than the front end surface 33 of the porcelain insulator 3, so that a portion of the porcelain insulator 3 which is exposed to the shock wave pressure, as created by combustion of fuel in the engine 100, will be a portion thereof which is located inside the front end surface 33 in the plug axial direction and has a higher mechanical strength, thus alleviating possible adverse effects on the porcelain insulator 3.

The inner end edge of each of the air vents 24 is located outside the outer circumference (i.e., an outer edge) of the ground electrode 5 on the front end surface 211 of the housing 2, thereby facilitating the ease with which a laser beam is continuously irradiated to the whole of the outer periphery of the ground electrode 5 to improve the reliability of a mechanical joint between the ground electrode 5 and the housing 2.

The structure of the spark plug 1 of this embodiment offers the same other beneficial advantages as in the first embodiment.

Fourth Embodiment

Figure 17:
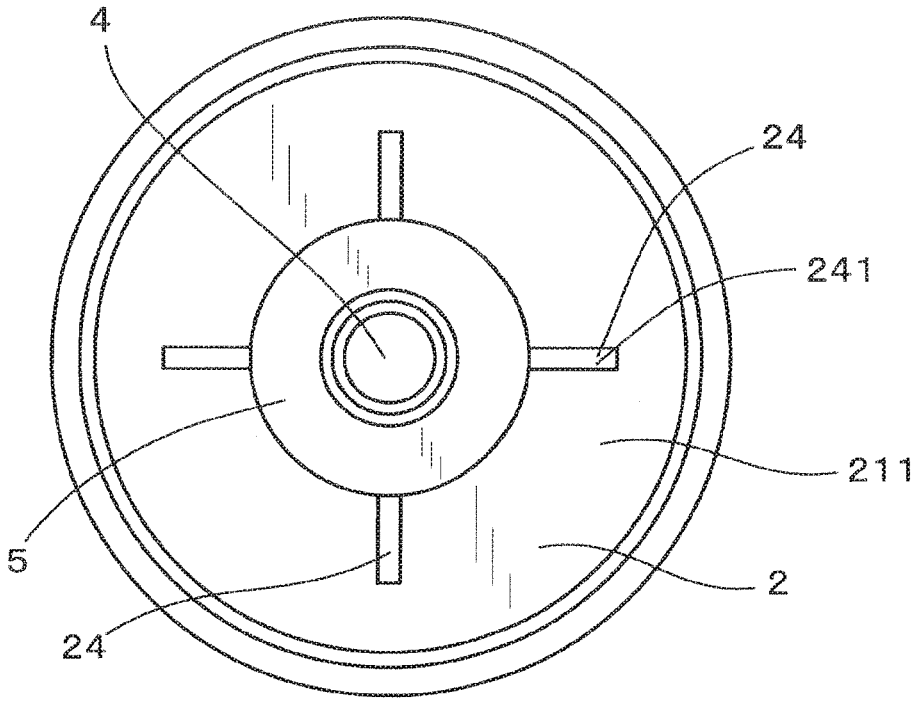
FIG. 17 is a plane view which illustrates a spark plug, as viewed from a top end thereof according to the fourth embodiment.
Figure 18:
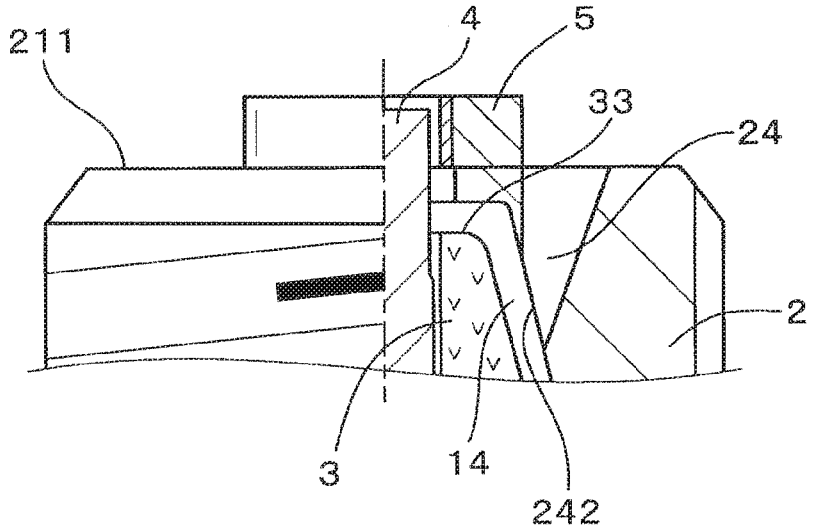
FIG. 18 is a partial longitudinal section view which illustrates a region around a top end portion of a spark plug of the fourth embodiment.

The spark plug 1 of this embodiment, as illustrated in FIGS. 17 and 18, have the vent holes 24 each of which is geometrically designed to have a rectangular transverse section elongated in the plug radial direction.

Specifically, although not clearly illustrated in the drawings, an inner end edge of each of the vent holes 24 is located radially slightly inside an outer end edge (i.e., an outer circumference) of the ground electrode 5 in order to compensate for a dimensional or locational (or alignment) error of the ground electrode 5 to secure a desired total open area of the vent holes 24. The air vents 24 extend radially in the plug radial direction, as viewed in the plug axial direction.

Other arrangements are identical with those in the first embodiment, and explanation thereof in detail is omitted here.

In the fourth embodiment, the air vents 24 are exposed to a wider region of the pocket 14 in the plug radial direction, thereby enabling the pocket 14 to be fully scavenged through the air vents 24 over the wider region thereof in the plug radial direction.

Each of the air vents 24 has an inner peripheral surface extending parallel to the plug axial direction, thereby ensuring, like in the first embodiment, the stability in scavenging the pocket 14. Each of the air vents 24 has the opening 242 which is closer to the pocket 14 and located inside the front end surface 33 of the porcelain insulator 3 in the plug axial direction, so that a portion of the porcelain insulator 3 which is exposed to the shock wave pressure, as created by combustion of fuel in the engine 100, will be a portion thereof which is located inside the front end surface 33 in the plug axial direction and has a higher mechanical strength, thus alleviating possible adverse effects on the porcelain insulator 3.

The structure of the spark plug 1 of this embodiment offers the same other beneficial advantages as in the first embodiment.

Fifth Embodiment

Figure 19:
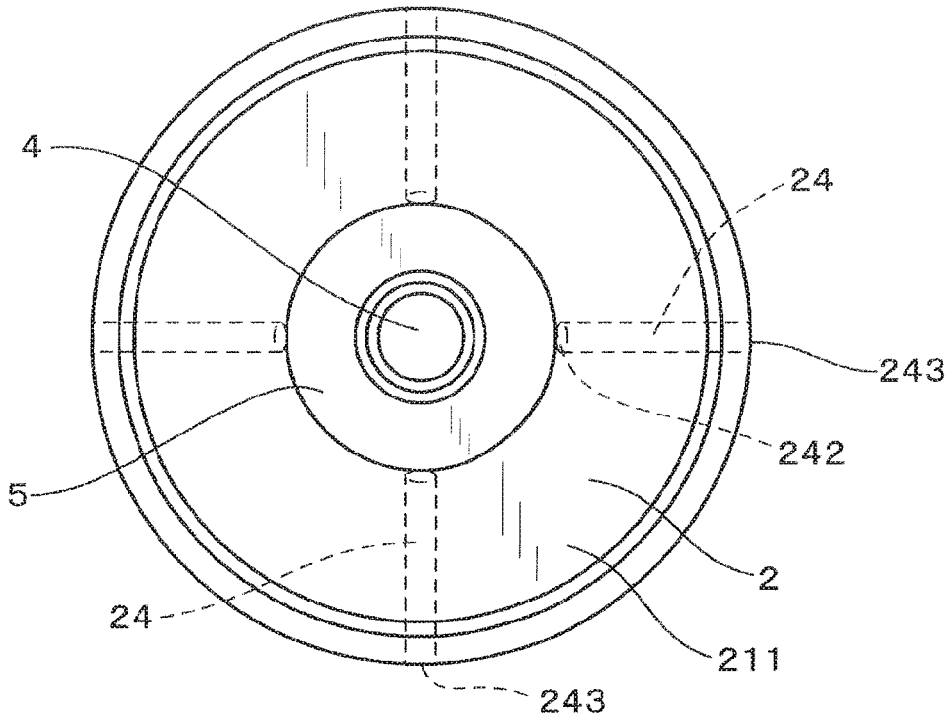
FIG. 19 is a plane view which illustrates a spark plug, as viewed from a top end thereof according to the fifth embodiment.
Figure 20:
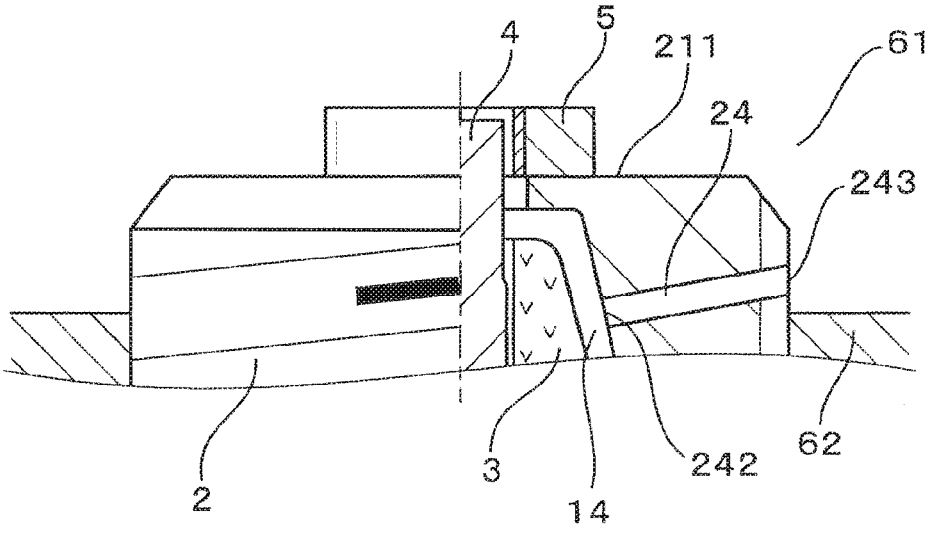
FIG. 20 is a partial longitudinal section view which illustrates a region around a top end portion of a spark plug of the fifth embodiment.

The spark plug 1 of this embodiment, as illustrated in FIGS. 19 and 20, have the vent holes 24 each of which is geometrically designed to have the opening 243 which is farthest away from the pocket 14 and formed on an outer peripheral surface of the housing 2.

Specifically, each of the air vents 24 extends to make a fluid communication between inside and outside the housing 2 near the front end of the housing 2. When the spark plug 1 is mounted in the engine head 62, the opening 243 of each of the air vents 24 is, as can be seen in FIG. 20, located closer to the front end of the spark plug 1 than the engine head 62 is.

Other arrangements are identical with those in the first embodiment, and explanation thereof in detail is omitted here.

The air vents 24 of this embodiment also serve to establish a fluid communication between the pocket 14 and the combustion chamber 61, thereby facilitating the ease with which the pocket 14 is scavenged through the air vents 24.

The structure of the spark plug 1 of this embodiment offers the same other beneficial advantages as in the third embodiment.

Sixth Embodiment

Figure 21:
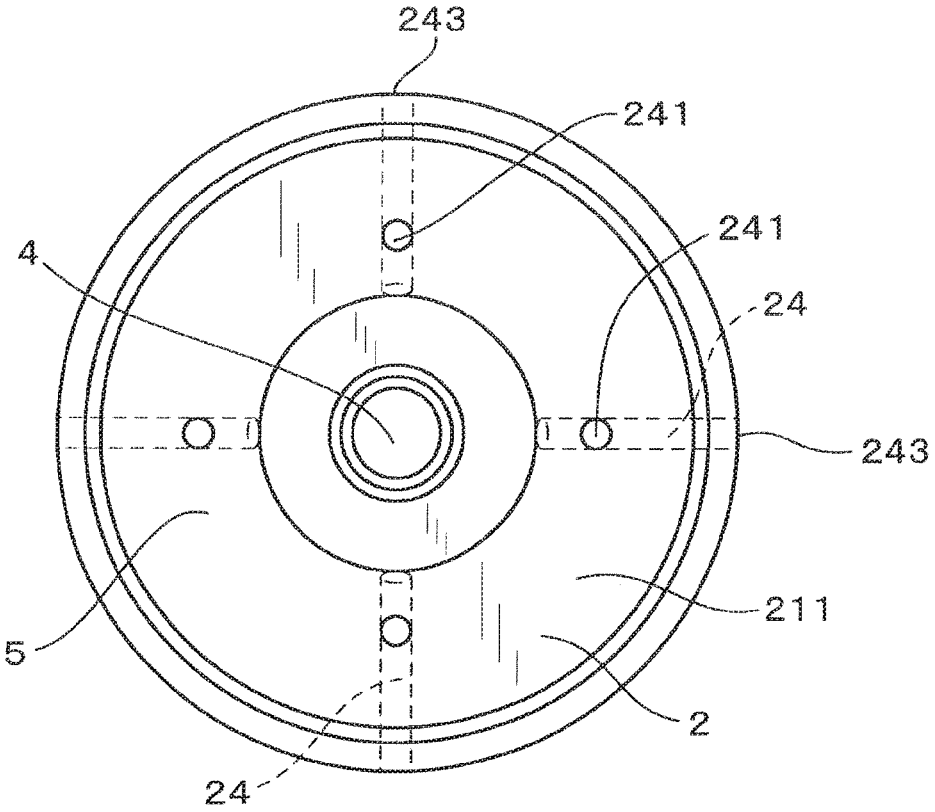
FIG. 21 is a plane view which illustrates a spark plug, as viewed from a top end thereof according to the sixth embodiment.
Figure 22:
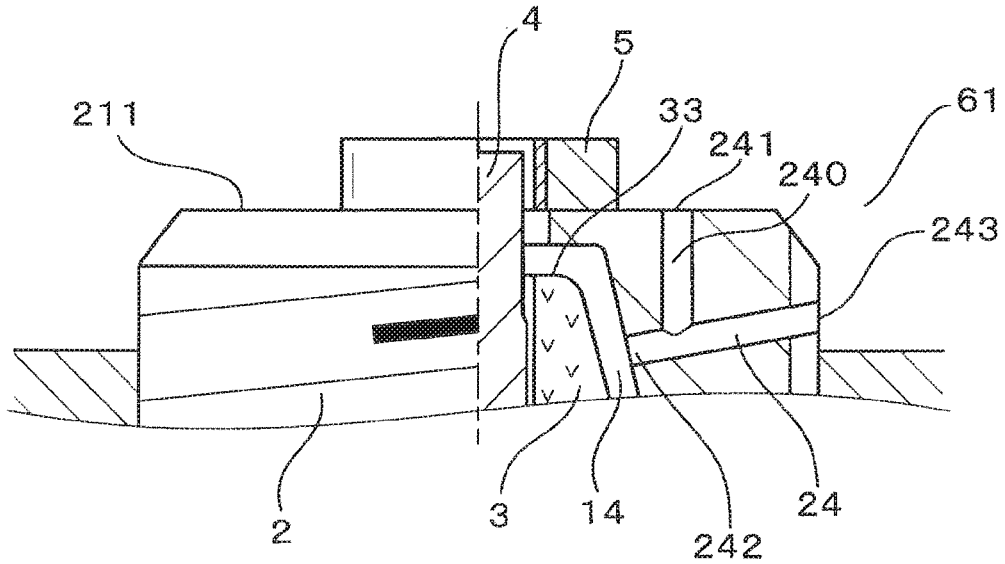
FIG. 22 is a partial longitudinal section view which illustrates a region around a top end portion of a spark plug of the sixth embodiment.

The spark plug 1 of this embodiment is, as illustrated in FIGS. 21 and 22, a modification of the first embodiment and designed to have at least one branch path diverging from each of the air vents 24.

Specifically, the spark plug 1 has the air vents 24 which are identical in structure with those in the fifth embodiment and also has branch paths 240 each of which diverges from a portion of a respective one of the air vents 24 to the front end of the housing 2. In other words, each of the air vents 24 has the opening 243 exposed to the outer peripheral surface of the housing 2 and the opening 241 exposed to the front end surface 211 of the housing 2.

Other arrangements are identical with those in the first embodiment, and explanation thereof in detail is omitted here.

The use of the branch paths 240 enhances the ability of the spark plug 1 to scavenge the pocket 14.

The structure of the spark plug 1 of this embodiment offers the same other beneficial advantages as in the first and third embodiments.

Seventh Embodiment

Figure 23:
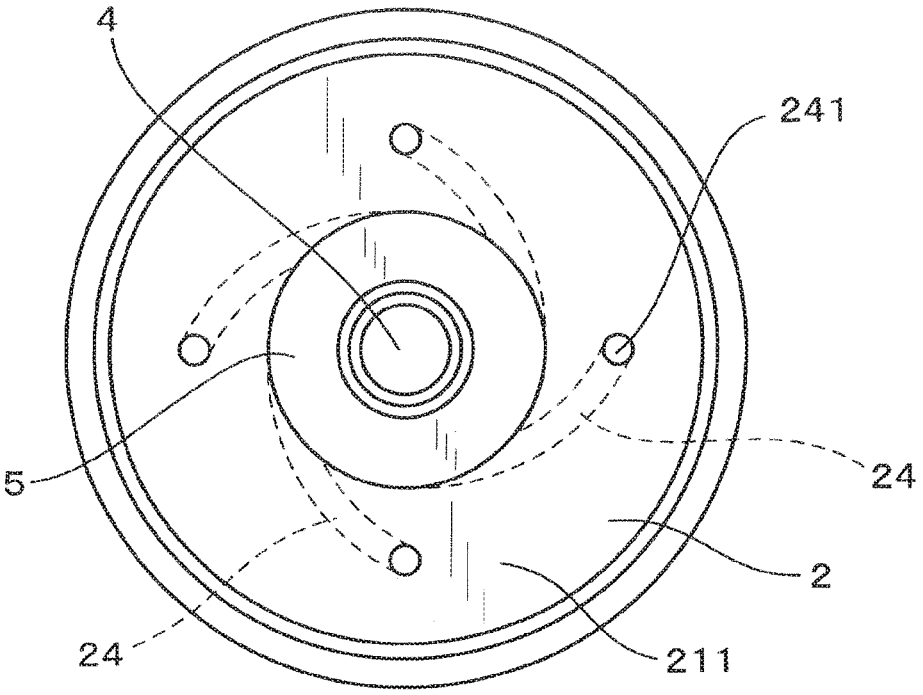
FIG. 23 is a plane view which illustrates a spark plug, as viewed from a top end thereof according to the seventh embodiment.
Figure 24:
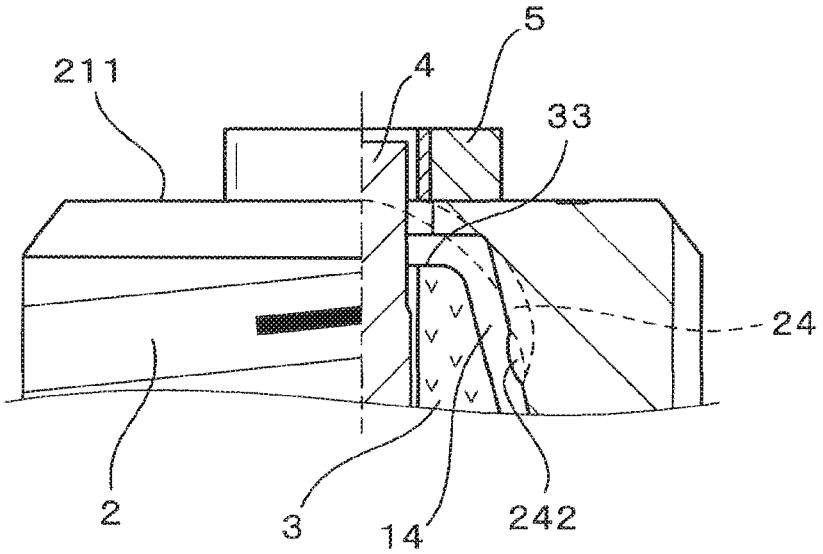
FIG. 24 is a partial longitudinal section view which illustrates a region around a top end portion of a spark plug of the seventh embodiment.

The spark plug 1 of this embodiment, as illustrated in FIGS. 23 and 24, have the vent holes 24 each of which is shaped in a spiral form.

All the air vents 24 are curved helically in the same circumferential direction of the spark plug 1.

Other arrangements are identical with those in the first embodiment, and explanation thereof in detail is omitted here.

There may be the need for changing how to scavenge the pocket 14 of the spark plug 1 depending upon the structure of the combustion chamber 61. Specifically, in the case where the air swirls along the spiral curves of the air vents 24 within the combustion chamber 61 during an exhaust stroke of the piston of the engine 100, the air vents 24 of this embodiment facilitate the ease with which the pocket 14 is scavenged.

For instance, some internal combustion engines for use with cogeneration systems are equipped with a sub-combustion chamber located around a spark-generating portion of the spark plug 1 and a main combustion chamber arranged outside the sub-combustion chamber. The air in the sub-combustion chamber may swirl spirally depending upon arrangement of holes formed in the sub-combustion chamber. In such a case, the air vents 24 of this embodiment are useful for facilitating the scavenging of the pocket 14.

The structure of the spark plug 1 of this embodiment offers the same other beneficial advantages as in the first and third embodiments.

Eighth Embodiment

Figure 25:
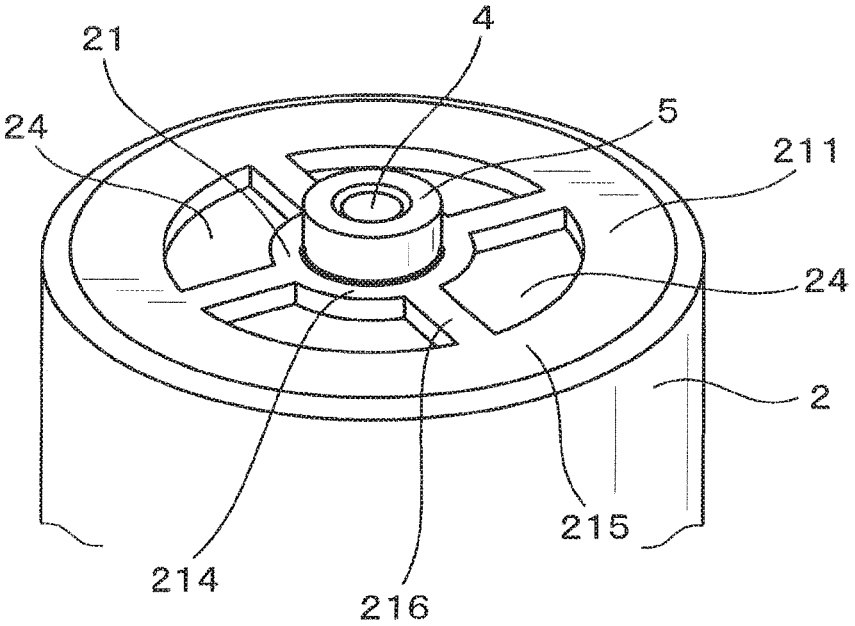
FIG. 25 is a partial perspective view which shows a spark plug according to the eighth embodiment.

The spark plug 1 of this embodiment is, as illustrated in FIG. 25, designed to have the air vents 24 each of which has a large-sized opening located outside the outer periphery of the ground electrode 5 in the plug radial direction.

Specifically, the small-diameter portion 21 of the housing 2 includes a center annular portion 214, an outer annular portion 215, and connecting portions or ribs 216. The center annular portion 214 is formed on the center of the small-diameter portion 21. The outer annular portion 215 is located outside the center annular portion 214. The ribs 216 extend in the plug radial direction and connect the center annular portion 214 and the outer annular portion 215 together. The center annular portion 214, the outer annular portion 215, and the ribs 216 define the air vents 24 among them which lead to the pocket 14.

The center annular portion 214 has an outer edge located outside the outer periphery of the ground electrode 5.

Other arrangements are identical with those in the first embodiment, and explanation thereof in detail is omitted here.

The structure of the spark plug 1 of this embodiment provides the large-sized air vents 24, thus enhancing the ability of the spark plug 1 to scavenge the pocket 14.

The outer periphery of the center annular portion 214 is, as described above, located outside the outer periphery of the ground electrode 5, thereby facilitating the ease with which a laser beam is continuously irradiated to the whole of the outer periphery of the ground electrode 5 to connect the ground electrode 5 to the housing 2, which improves the reliability of the mechanical joint between the ground electrode 5 and the housing 2.

The structure of the spark plug 1 of this embodiment offers the same other beneficial advantages as in the first and third embodiments.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

Figure 26:
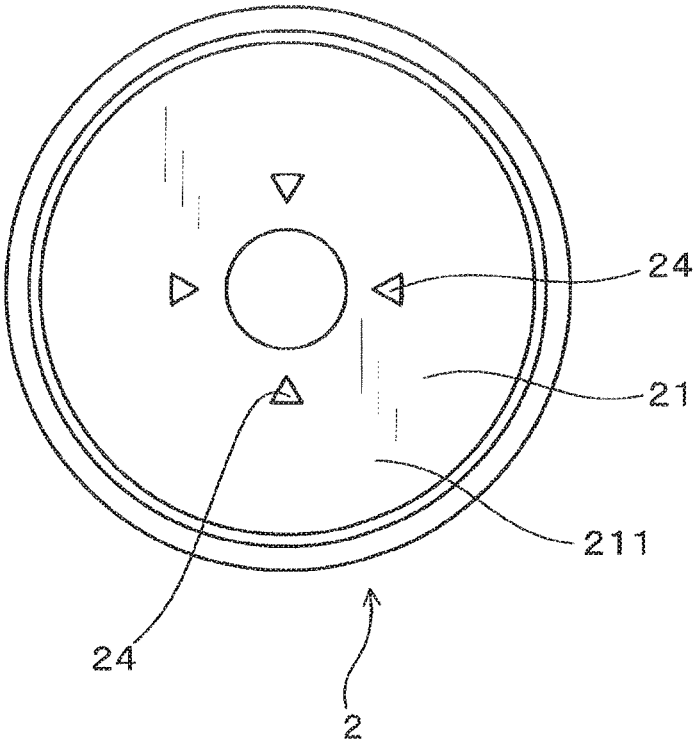
FIG. 26 is a plane view which shows a first modified form of a front end surface of a housing of a spark plug.
Figure 27:
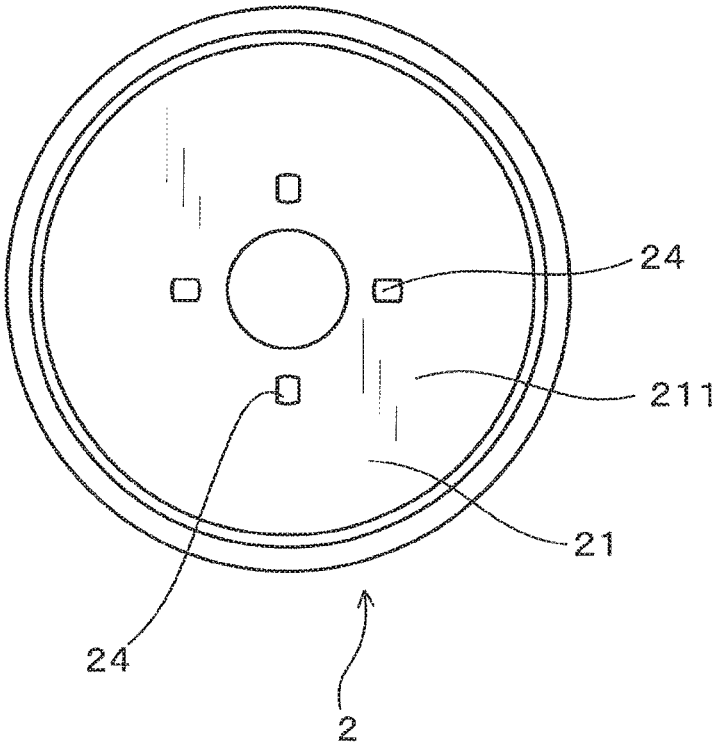
FIG. 27 is a plane view which shows a second modified form of a front end surface of a housing of a spark plug.

The configuration of the air vents 24 is also not limited to the ones, as described above. For instance, each of the air vents 24 may be shaped to have, as illustrated in FIG. 26, a triangular transverse section or, as illustrated in FIG. 27, a substantially square transverse section. In the former case, the opening of each of the air vents 24 may have a wider area of an outer portion thereof in the plug radial direction, which is effective in enhancing the ability of the spark plug 1 to scavenge the pocket 14. In the latter case of FIG. 27, the air vents 24 may have an increased area of the opening thereof.

The air vents 24 may lead to the inner periphery of the small-diameter portion 211 of the housing 2. In other words, each of the air vents 24 may be designed to partially communicate with the center hole of the ground electrode 5.

What is claimed is:

1. A spark plug for an internal combustion engine comprising:

a cylindrical housing which is designed to be mounted in an internal combustion engine so as to be exposed to a combustion chamber of the internal combustion engine;

a cylindrical porcelain insulator which is retained inside the housing;

a center electrode which is retained inside the porcelain insulator and has a head extending outside a front end of the porcelain insulator; and an annular ground electrode which is secured to a front end of the housing, wherein the housing has a small-diameter portion formed on the front end thereof, the small-diameter portion having an inner diameter which is smaller than that of a rest of the housing, wherein the ground electrode protrudes from a front end surface of the small-diameter portion and has an inner peripheral surface facing an outer peripheral surface of the center electrode, wherein the ground electrode has an outer diameter which is smaller than an outer diameter of the front end surface of the small-diameter portion, wherein the porcelain insulator has a mounting shoulder formed on an outer periphery thereof, and the housing has a seat shoulder formed on an inner periphery thereof, the mounting shoulder riding on the seat shoulder from a base side of the spark plug in an axial direction of the spark plug to retain the porcelain insulator in the housing, wherein a pocket is formed between the inner periphery of the housing and a portion of the porcelain insulator which is located closer to a front end of the porcelain insulator than the mounting shoulder is, and wherein the housing has formed therein an air vent which extends from outside the ground electrode in a radial direction of the spark plug to the pocket to establish a communication between the pocket and the combustion chamber of the internal combustion engine.

2. A spark plug as set forth in claim 1, wherein the air vent is exposed to the front end surface of the small-diameter portion of the housing.

3. A spark plug as set forth in claim 2, wherein the housing also has air vents each of which extends from outside the ground electrode in the radial direction of the spark plug to the pocket to establish a communication between the pocket and the combustion chamber of the internal combustion engine, all the air vents extending parallel to the axial direction of the spark plug.

4. A spark plug as set forth in claim 1, wherein the air vent opens at an outer periphery of the housing.

5. A spark plug as set forth in claim 3, wherein the air vents are arranged at equal intervals away from each other in a circumferential direction of the spark plug.

6. A spark plug as set forth in claim 1, wherein the air vent has a front side opening and a base side opening which is located closer to a base end of the housing than the front side opening, the base side opening being arranged closer to the base end of the housing than the front end surface of the porcelain insulator is.

7. A spark plug as set forth in claim 1, wherein an annular boundary through which the front end surface of the small-diameter portion and a base end surface of the ground electrode face each other has an annular region which occupies a portion of a width thereof and fully extends in a circumferential direction thereof and in which an annular weld is formed which establishes a joint between the housing and the ground electrode, the annular weld continuously extending in a circumferential direction of the annular region, and wherein the air vent is located outside the annular weld in the radial direction of the spark plug.

* * * * *